United States Patent [19]

Crain

[11] 4,445,806

[45] May 1, 1984

[54] SHEET PILING OR MOORING CELL

[76] Inventor: Graydon H. Crain, Freedom Rd., R.D. #5, Mars, Pa. 16046

[21] Appl. No.: 397,556

[22] Filed: Jul. 12, 1982

[51] Int. Cl.[3] ..... E02B 3/22; E02D 5/60

[52] U.S. Cl. ..... 405/216; 405/218

[58] Field of Search ..... 405/14, 211, 216, 218, 405/276; 114/230

[56] References Cited

U.S. PATENT DOCUMENTS

| | | | |
|---|---|---|---|
| 2,181,526 | 11/1939 | Upton | 405/216 |
| 3,527,057 | 9/1970 | Riester | 405/14 |
| 4,116,013 | 9/1978 | Hellmers | 405/216 |
| 4,252,471 | 2/1981 | Straub | 405/211 |

FOREIGN PATENT DOCUMENTS

| | | | |
|---|---|---|---|
| 1439214 | 6/1976 | United Kingdom | 405/216 |

*Primary Examiner*—David H. Corbin

*Attorney, Agent, or Firm*—William J. Ruano

[57] ABSTRACT

An enclosure for reinforcing and preventing loss of contents of a sheet piling or mooring cell particularly just below the water line. Such apparatus comprises metal sheets of semi-circular construction which are bolted together so as to completely and tightly encircle the sheet piling. The semi-circular parts may be made of welded portions.

2 Claims, 7 Drawing Figures

SHEET PILING OR MOORING CELL

This invention relates to a sheet piling or mooring cell and, more particularly, to an enclosure to effect repair thereof as well as reinforcement in the area of the water line where greatest rust and damage occurs.

In the past, when a mooring cell would rust and form holes which enabled the aggregate or other filling to spill into the surrounding water, it was felt that replacement of the entire mooring cell was necessary.

An object of my invention is to provide a novel enclosure assembly for surrounding the sheet piling, where damaged, and avoid the necessity of replacement.

A more specific object of the invention is to provide a pair of reinforcing semi-circular sheets which surround a piling cell in the area immediately above and below the water line to prevent leakage of the aggregate filling and to effect reinforcement of the entire piling cell.

Other objects and advantages will become more apparent from a study of the following description taken with the accompanying drawing wherein.

Figure 1:
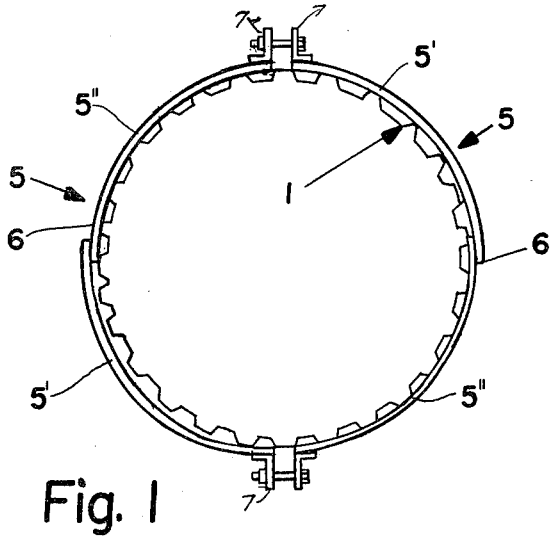
FIG. 1 is a top or plan view of sheet mooring or piling cell embodying my reinforcing and leakage preventing enclosure.
Figure 2:
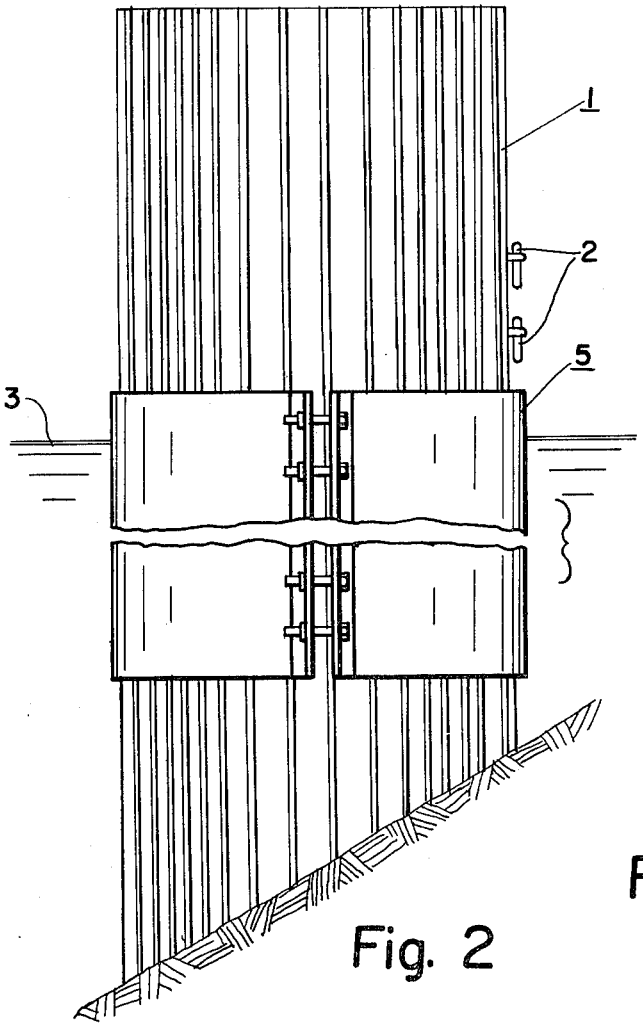
FIG. 2 is an elevational view of the piling cell shown in FIG. 1.
Figure 4:
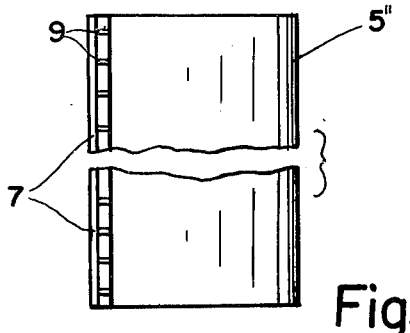
FIG. 4 is an elevational view in reduced size, of the semi-circular sheet shown in FIG. 3.

Referring more particularly to FIGS. 1 and 2 of the drawing, numeral 1 generally denotes a corrugated sheet piling or mooring cell whose bottom end is sunk in the ground at the bottom of a river for anchoring boats and ships by anchor rings 2 as shown. Numeral 3 denotes the surface of the river or other body of water.

Figure 3:
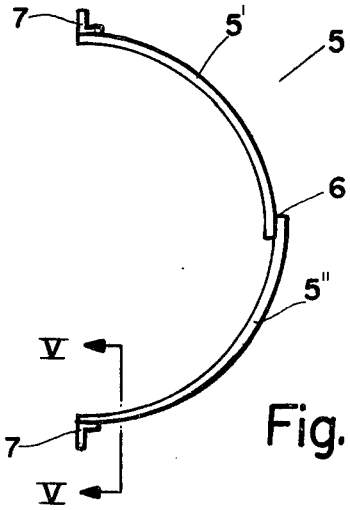
FIG. 3 is a plan view of one of the semi-circular reinforcing sheets shown in FIGS. 1 and 2.

Experience has shown that earliest signs of rust and rusted out openings formed in the cell and through which the aggregate filling of the piling 1 may escape is in the vicinity of the river level 3. To overcome the common procedure of replacing the piling by a new structure, or perhaps having a diver attempt to perform welding operations or patching operations beneath the level 3, the present invention provides two semi-circular metal sheets 5,5 each formed of the construction shown in FIG. 3, that is, with intermediate portions 5' and 5'' lap welded together at 6. Flanges 7 are then welded to the ends of sheets 5,5 which are reinforced by chocks 9. Then the two semi-circular portions 5,5 are lowered in surrounding relationship to the piling 1 and in a position where it surrounds the area of greatest damage from rusting and formation of holes as shown in FIG. 2 the end flanges 7,7 are bolted together as shown so as to hold the semi-circular piece 5,5 tightly around the piling 1. It will be noted that the bolts are in a different area than the mooring rings 2 so that vessels will not damage the bolted flanges 7.

Figure 7:
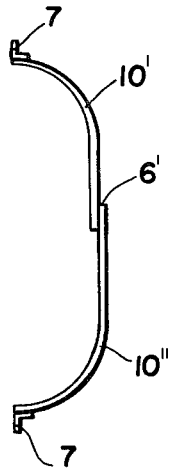
FIG. 7 is a plan view of a modification of the reinforcement shown in FIG. 3 for adaption to other than a circular shape of piling.
Figure 5:
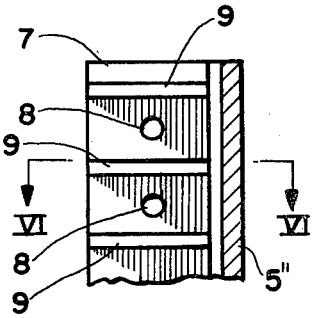
FIG. 5 is an enlarged cross-sectional view taken along line V—V of FIG. 5.
Figure 6:
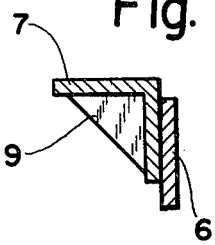
FIG. 6 is an enlarged cross-sectional view taken along line VI—VI of FIG. 3 showing the chock.

In some instances, instead of making semi-circular flanges, they may be made of the shape shown in FIG. 7 to encircle corresponding shapes of mooring or perhaps two cells.

When the semi-circular plates 5,5 are bolted in position as, shown in FIGS. 1 and 2, they will prevent leakage of any aggregate or other contents of the piling into the surrounding water. Also they will provide needed reinforcement for the weakened portion of the mooring or piling which occurs generally immediately below the water line. By the structure of the present invention, the life of the piling or mooring cell may be extended many years with a minimum of expenditure. Moreover, the installation on the mooring or piling cell is relatively easy and inexpensive, requiring merely a diver to tighten the bolts under the water level.

Thus it will be seen that I have provided an efficient apparatus for reinforcing and preventing leakage of a mooring cell involving a minimum cost and greatest simplicity of installation, also which is effective to extend the life of the mooring cell for many years.

While I have illustrated and described several specific embodiments of my invention, it will be understood that they are by way of illustration only and that various changes and modifications may be contemplated in my invention within the scope of the following claims.

I claim:

1. In combination with a mooring cell structure having a corrugated cylindrical configuration; the combination therewith of a pair of arcuate metallic sheets of substantially equal length secured together in metallic contact with and directly surrounding said cells to provide a direct mechanical reinforcing layer and extending only in the area immediately above and below a river water line, flanges secured to the ends of said sheets, a plurality of longitudinally spaced bolting means for holding together said flanges of said arcuate sheets so as to tightly encircle the mooring cell structure and prevent loss of the contents thereof as well as to effect direct reinforcement of the cell together with vertically spaced mooring rings secured to said mooring cell structure at a position of about 90° away from said flanges to protect said flanges from damage by vessels.

2. The combination recited in claim 1 together with a chock integrally secured to each of said flanges for reinforcement.

* * * * *